US007967267B1

(12) United States Patent
Cantolino

(10) Patent No.: US 7,967,267 B1
(45) Date of Patent: Jun. 28, 2011

(54) CLAMPING ASSEMBLY WITH INTEGRAL RAIL PLATE

(76) Inventor: Christopher Ralph Cantolino, Bradenton, FL (US)

( * ) Notice: Subject to any disclaimer, the term of this patent is extended or adjusted under 35 U.S.C. 154(b) by 430 days.

(21) Appl. No.: 12/177,228

(22) Filed: Jul. 22, 2008

Related U.S. Application Data

(63) Continuation-in-part of application No. 12/012,307, filed on Jan. 31, 2008, now Pat. No. 7,710,283.

(51) Int. Cl.
*A47B 96/06* (2006.01)

(52) U.S. Cl. ..... 248/231.61; 248/213.2

(58) Field of Classification Search ..... 248/228.2, 248/229.14, 229.24, 228.5, 230.5, 231.61, 248/213.2; 200/84 R
See application file for complete search history.

(56) References Cited

U.S. PATENT DOCUMENTS 2,634,928 A * 4/1953 Hawes ..... 248/514
3,176,707 A * 4/1965 Wilson ..... 137/315.08
5,618,128 A * 4/1997 Chen ..... 403/344
6,342,138 B1 * 1/2002 Brown ..... 204/297.09
6,685,385 B1 * 2/2004 Ledingham ..... 403/400
6,730,865 B1 * 5/2004 Hernandez-Zelaya ..... 200/84 R
6,992,260 B1 * 1/2006 Cantolino ..... 200/84 R
7,067,749 B1 * 6/2006 Cantolino ..... 200/84 R
7,067,750 B1 * 6/2006 Cantolino ..... 200/84 R

* cited by examiner

*Primary Examiner* — Anita M King
(74) *Attorney, Agent, or Firm* — Dorothy S. Morse

(57) ABSTRACT

A two-piece clamping assembly with an integral rail plate used to rapidly and securely mount a float switch within a fluid collection container for fluid level monitoring. It is usable with both metal and plastic condensate collection pans, and successfully accommodates their differing wall thickness dimensions and different upper edge configurations. When its front and back clamping members are joined together over the top edge, lip, or flange of a pan using one centrally located top fastener, and at least one additional fastener is inserted through the back clamping member until it engages the exterior surface of the pan, the pan's upper edge becomes secured within an inverted J-shaped slot formed between the two clamping members. Vertically-extending internal ribs and horizontally-extending projections strengthen the clamping assembly. Preferred plastic materials also make the clamping assembly impervious to corrosion.

20 Claims, 6 Drawing Sheets

FIG. 1
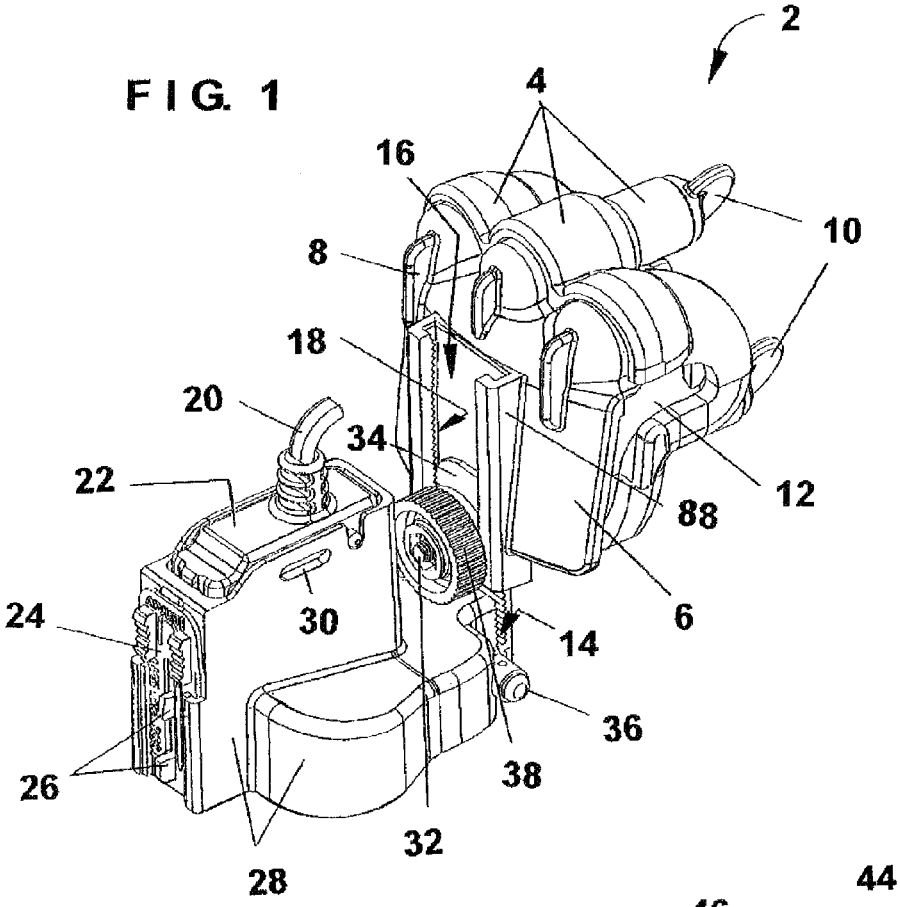
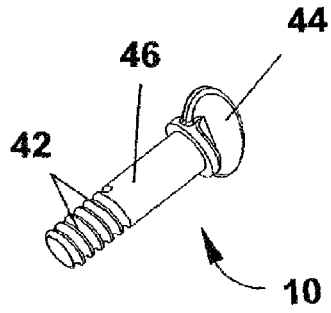
FIG. 2

CLAMPING ASSEMBLY WITH INTEGRAL RAIL PLATE

CROSS-REFERENCES TO RELATED APPLICATIONS

This application is a continuation-in-part of still U.S. Ser. No. 12/012,307, filed by the same inventor for overlapping and substantially similar subject matter on Jan. 31, 2008 now U.S. Pat. No. 7,710,283. All possible benefit of this previously filed patent application is herein requested.

BACKGROUND OF THE INVENTION

1. Field of the Invention

This invention relates to clamping devices, specifically to a clamping assembly with two-piece construction and an integral rail plate that can be used to rapidly and securely mount a float switch within a metal or plastic fluid collection container for fluid level monitoring. It is attached over the top edge, lip, or outwardly-directed flange of a vertically-extending wall of the fluid collection container, and successfully accommodates differing wall thickness dimensions, as well as different upper edge, lip, and flange configurations. No hole is required in the container wall for its mounting. When its front and back clamping members are joined together over a container's top edge, lip, or flange, only one centrally located top fastener is typically used between them. However, one or more additional fasteners (preferably two) are also inserted through the back clamping member and tightened until they engage a portion of the container's exterior surface situated below the top edge, lip, or flange. After all fasteners are tightened, the container's upper edge, lip, or flange becomes securely fixed within an inverted J-shaped slot formed between the two clamping members, and any float switch housing firmly secured to the rail plate depending from the front clamping member is also maintained in secure fixed relation to the fluid collection container for prompt, reliable, and repeatable upward deployment of its pivotally-secured float body in response to rising fluid in the container, which after a pre-determined threshold fluid level considered safe is exceeded will activate a micro switch also supported by the float switch housing and cause it to send a shut-off signal to the fluid-producing unit or system responsible for the rising fluid. The sturdy and substantial construction of the front and back clamping members, the secure and non-wobbling engagement of the clamping assembly to the container wall achieved via the two-piece construction and the inverted J-shaped slot, and the secure and non-wobbling connection of the float switch housing to the rail plate integral to the front clamping member, all significantly reduce the opportunity for a change in float switch orientation that could diminish its responsiveness or function. The secure engagement of the clamping assembly to the container wall is enhanced by a plurality of vertically-extending internal ribs and at least two internally located horizontally-extending posts that strengthen the clamping assembly during its installation and use, as well as a ridged surface configuration on the lower portion of the vertically-extending ribs integral to the interior surface of the front clamping member that help to reduce movement of the container wall within the inverted J-shaped slot once clamping assembly installation over the top edge, lip, or flange of the wall is complete. In addition, preferred plastic materials make the clamping assembly impervious to corrosion and reliable for extended duration use. Furthermore, a thumbscrew having an oversized head preferably secures the front and back clamping members to one another, and at least one additional thumbscrew having an oversized head preferably secures the back clamping member against the exterior surface of the fluid collection container, thereby facilitating and expediting clamping assembly installation over the top edge, lip, or flange of the vertically-extending wall of a fluid collection pan, as well as rapid release of clamping members from one another, as needed. The present invention clamping assembly has important fluid level monitoring applications and provides important benefits during its installation and use, and furthermore, no other clamping assembly is known with the same inverted J-shaped slot and rail plate structure.

2. Description of the Related Art

When air conditioning condensate and other fluids are collected, there is often a risk of overflow or back-up into the system producing it, even when a large fluid collection pan or other large container is employed to collect the generated fluid, or a drain line connection is added. As a result, liquid-level monitoring float switches have been used with fluid collection pans for automated shut-off of the source of condensate flow when the amount of fluid collected exceeds a predetermined threshold depth considered safe. However, many known and currently used float switches are mounted in a manner that subjects them to malfunction, less reliable operation, costly installation, and/or unstable installation. First, the fluid collection pans used for condensate and other fluid collection do not always have a sturdy construction. Therefore, when a float switch is added to a pan wall, it often causes the wall to lean in and adversely affect the orientation of the float body pivotally secured inside the float switch housing, which relies on gravity to bring it back to its pre-deployment position for repeated use, and as the float body orientation becomes changed, its responsiveness to rising fluid levels may become diminished or sporadic, thus negating its primary purpose of reliable fluid monitoring and shut-off when a threshold depth of water considered safe is exceeded. Also, the plastic pans used can have varying upper edge configurations (which are usually different from the typically straight-walled metal fluid collection pans) and the means used for securely attaching a float/switch/housing combination to one type of pan so as to achieve proper float switch function, may or may not be able to securely attach the float/switch/housing combination to other pans with different upper edge thickness dimensions or configurations. Further, depending upon the location of the collection pan, a float/switch/housing combination mounted thereto may be at risk for malfunction as a result of airborne debris, such as but not limited to the insulation fibers often encountered in attics where air conditioning system condensing units are frequently located. Also, when the installation of prior art float switches requires the drilling of at least one hole through the support surface or pan, installation cost is increased. In contrast, the present invention uses a fastener to securely fix two clamping members to one another over the top edge, lip, or flange of a fluid collection pan and at least one fastener is also used to secure the back clamping member against the exterior surface of the pan, and no pre-made hole or on-site drilling is required for clamping member installation, reducing installation time and expense. Furthermore, a plurality of present invention features (including but not limited to vertically-extending ribs and horizontally-extending posts) add strength to the clamping members and allow more successful and stable installation on weaker fluid collection pan walls, walls made with a small thickness dimension and/or materials less capable of withstanding the high temperatures encountered in attic installations, as well as walls having inconsistent thickness dimension, by overcoming the lean in and resulting change to float body orientation that would be expected to diminish or otherwise adversely affect its float body responsiveness to rising fluid in an associated fluid collection pan. In addition, the inverted J-shaped slot formed between the front and back clamping members (when they are joined together) is adjustable and configured to accommodate the wide variety of upper edge configurations and thickness dimensions currently found in plastic and metal condensate collection pans, so that proper float switch installation and function can be promptly achieved without the need for an installer of float switches having to transport an assortment of clamping assemblies to a work site and then having to take further time to test and select the one that best fits over the top edge, lip, or the outwardly-directed flange of a previously installed fluid collection pan, or in the alternative encounter the time delay during float switch installation associated with having to drill a hole in the pan.

BRIEF SUMMARY OF THE INVENTION

Objectives and Advantages

The primary object of the present invention is to provide a time-saving clamping assembly that is able to accommodate the differing upper edge configurations and thickness dimensions of a variety of plastic and metal fluid collection pans commonly used in fluid overflow prevention applications. It is also an object of the present invention to provide a clamping assembly that has the type of simple cost-effective construction and assembly needed for widespread distribution and use. A further object of the present invention is to provide a clamping assembly designed for prompt and cost-effective installation. It is also an object of the present invention to provide a clamping assembly that is adjustable for secure installation of a float switch and allowing the originally established orientation of the float switch to be substantially maintained during its entire period of use. Another object of the present invention is to provide a clamping assembly with a design that compensates for insubstantial condensate collection pan construction and overcomes lean in problems that could adversely change the orientation of a mounted float switch body and diminish the reliability of its operation. In addition, it is a further object of the present invention to provide a clamping assembly that is made from corrosion-resistant materials capable of resisting premature deterioration and malfunction for long duration use.

As described herein, properly manufactured and used, the present invention would provide a clamping assembly for mounting a float switch in a secure and fixed position of use relative to a fluid collection pan or other fluid collection container, wherein after mounting the float switch will be able to promptly, reliably, and repeatedly shut-off the flow of condensate or other fluid into the associated pan or container when the amount of fluid collected therein exceeds a predetermined maximum depth considered safe. Further, its inverted J-shaped slot allows the present invention clamping assembly to be successfully used with fluid collection containers having differing upper edge, lip, and flange configurations and different wall thickness dimensions. The present invention is typically made from plastic, and is thereby impervious to corrosion, which in combination with its sturdy construction avoids premature deterioration and/or malfunction. Also, it has a two-part structure and simple assembly, wherein the front and back clamping members are joined together to form an inverted J-shaped slot that contains the upper edge, lip, or flange of a fluid collection pan during clamping assembly use. Use of one fastener is typically sufficient to join the front and back clamping members together when it is employed in a central position near their top surfaces. Furthermore, a thumbscrew having an oversized head configured for easy hand manipulation is preferred as it facilitates and expedites clamping assembly installation. The use of an oversized thumbscrew also expedites separation of front and back clamping members from one another, when needed. Further, the use of a fastener for joining the front and back clamping members of the present invention to one another prevents the need for drilling any holes in a pan wall for float switch mounting, saving time and making the installation of a fluid level monitoring float switch via use of the present invention both efficient and cost-effective. Furthermore, the design of the present invention clamping members includes a plurality of vertically-extending ribs and at least two horizontally-extending posts that in combination provide sturdy construction that help to overcome insubstantial construction in a fluid collection pan wall, when encountered. In addition, the inverted J-shaped slot of the present invention and the use of oversized thumbscrews can provide an adjustable (but quickly made) and secure connection of the present invention clamping assembly to a wide variety of pan walls even though they have different upper edge, lip, or flange configurations, different wall thickness dimensions, and inconsistent wall thickness variation, as the large surface area contact provided for the pan wall within the inverted J-shaped slot compensates for weak pan wall construction to prevent lean in and adverse change in float body orientation that could potentially cause slower and/or sporadic shut-off signal generation. The use of an integral rail plate in association with the exterior surface of the front clamping member also facilitates and expedites the mounting of a float switch to a fluid collection pan for fluid-monitoring purposes, while also making the connection secure so that performance-reducing changes in the after-installation orientation of the float switch will not be experienced.

Although the description herein provides preferred embodiments of the present invention, it should not be construed as limiting the scope of the present invention clamping assembly. For example, variations in the size, location, number, and spaced-apart location of the multiple thumbscrew openings in the back clamping member; the depth and width dimensions of the substantially linear portion of the inverted J-shaped slot; the number, location, configuration, and relative spacing of the vertically-extending ribs on the front and back clamping members; the comparative height dimensions of the front and back clamping members; the configuration and dimension of the thumbscrew or other means used to join the front and back clamping members; in addition to those variations shown and described herein, may be incorporated into the present invention. Thus, the scope of the present invention should be determined by the appended claims and their legal equivalents, rather than being limited to the examples given.

BRIEF DESCRIPTION OF THE SEVERAL VIEWS OF THE DRAWINGS

FIG. 1 is a perspective view of the most preferred embodiment of the present invention having a two-part structure with front and back clamping members connected together via a single thumbscrew, with at least one other thumbscrew used to secure the back clamping member against the exterior surface of a fluid collection pan, and also with the front clamping member having an integral rail plate, a float switch housing securely but adjustably fixed to the rail plate via an easily hand-manipulated lock-nut having a grooved outer surface, and the float switch housing supporting a micro switch that can be configured for electrical connection to a fluid-producing unit or system to send it a shut-off signal when rising fluid in an associated fluid collection pan exceeds a pre-determined level considered safe.

FIG. 2 is perspective view of one configuration of thumbscrew that can be successfully used as a part of the most preferred embodiment of the present invention to join front and back clamping members together, and also to secure the back clamping member against the exterior surface of an associated fluid collection pan while the pan's upper edge, lip, or flange is inserted within the inverted J-shaped slot formed when the front and back clamping members are joined together, with the thumbscrew shown having an elongated configuration and an enlarged head of adequate size for easy hand-manipulation.

DETAILED DESCRIPTION OF THE INVENTION

Figure 5:
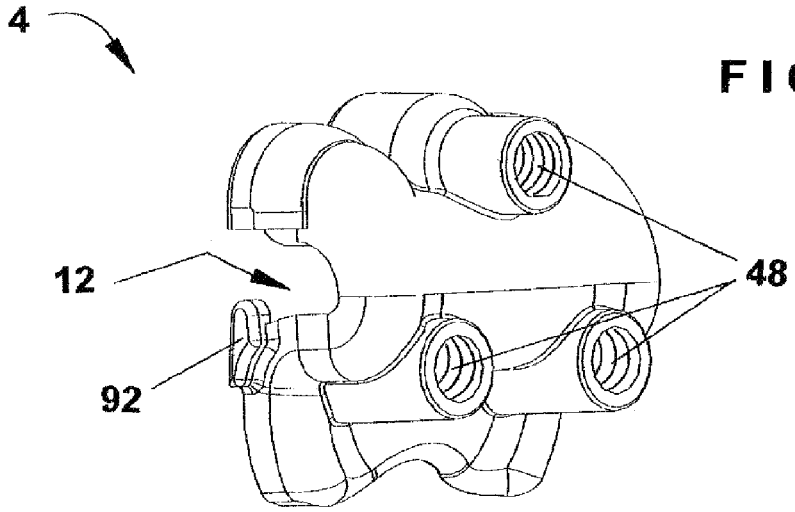
FIG. 5 is a perspective view of the exterior surface of the back clamping member used as a part of the most preferred embodiment of the present invention in a position of use located outside the wall of an associated fluid collection pan and secured to the exterior surface of the wall by at least one easily manipulated fastener, such as a thumbscrew, with the exterior surface of the back clamping member also shown to have three horizontally-extending threaded openings in a generally triangular spaced-apart configuration, a lateral cutout on each side that forms the top of the inverted J-shaped slot, and a lateral projection on each side below the lateral cutout that helps to secure the arcuate flange of a plastic fluid collection pan when it is positioned within the inverted J-shaped slot.
Figure 6:
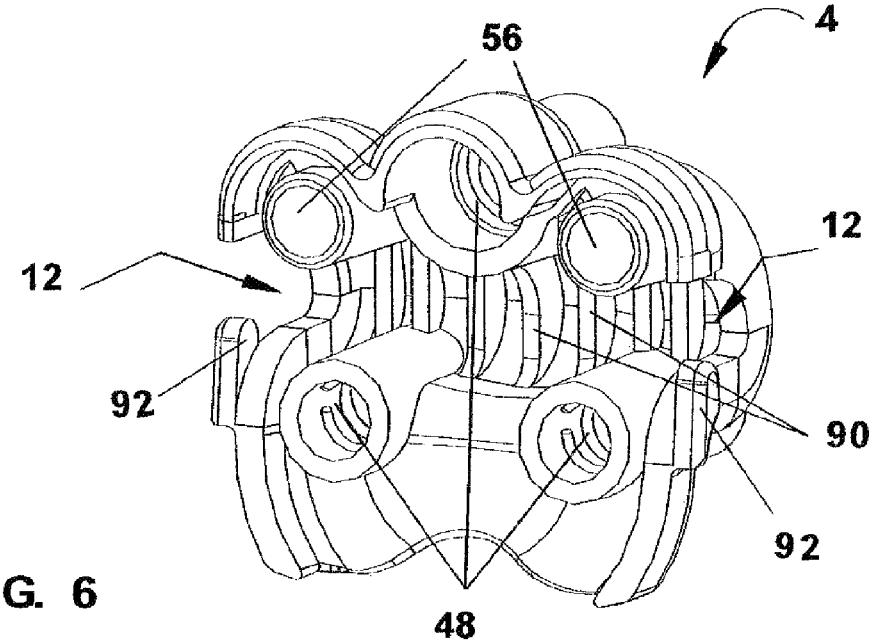
FIG. 6 is a front view of the interior surface of the back clamping member shown in FIG. 5, with FIG. 6 showing the back clamping member having a horizontally-extending threaded opening therethrough centrally near its top surface, as well as two horizontally-extending receiving bores each slightly larger in diameter dimension than the posts shown in FIGS. 3 and 4 and also configured for accepting one of the posts when the front and back clamping members are joined together, both of the receiving bores being located near the clamping member's top surface with one receiving bore situated on each side of the top threaded opening, and the interior surface of the back clamping member also being shown to have a lateral cutout on each side that forms the top of the inverted J-shaped slot, a lateral projection on each side that helps to secure the arcuate flange of a plastic fluid collection pan when it is inserted within the inverted J-shaped slot, two additional horizontally-extending threaded openings each positioned near to a different one of the lateral projections that in combination with the top threaded opening form a generally triangular configuration, and a plurality of vertically-extending ribs positioned between the top threaded opening and the two additional threaded openings that help to strengthen the back clamping member.
Figure 7:
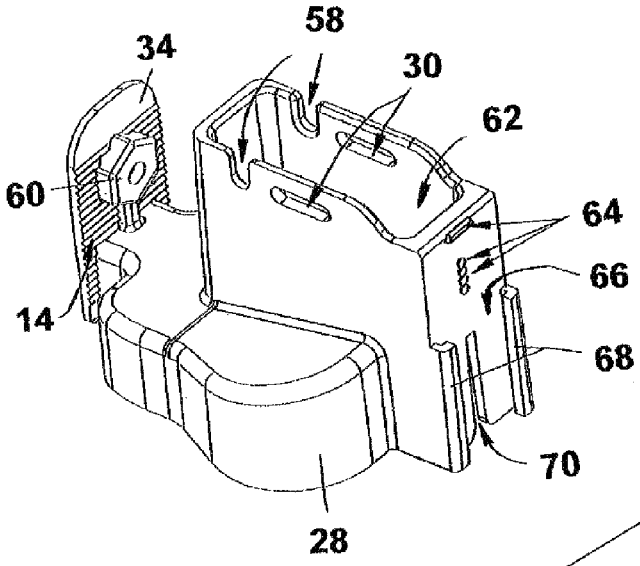
FIG. 7 is a perspective view of a float switch housing that can be successfully used with the most preferred embodiment of the present invention clamping assembly, with FIG. 7 showing the float switch housing having a rail plate connection member with structure complementary to that of the rail plate associated with the present invention's front clamping member, whereby secure engagement of the rail plate connection member to the rail plate via use of the lock-nut shown in FIG. 1 levels a float body secured for pivotal movement within the float switch housing and fixes the float body's elevation at the height needed for prompt, reliable and repeated vertical deployment in response to rising fluid in the fluid collecting container associated with the present invention clamping assembly, so that when the fluid accumulated in the container exceeds a pre-determined depth considered safe, the float body can properly interact with a micro switch also supported by the float switch housing and cause the micro switch to generate a shut-off signal to stop fluid production.
Figure 8:
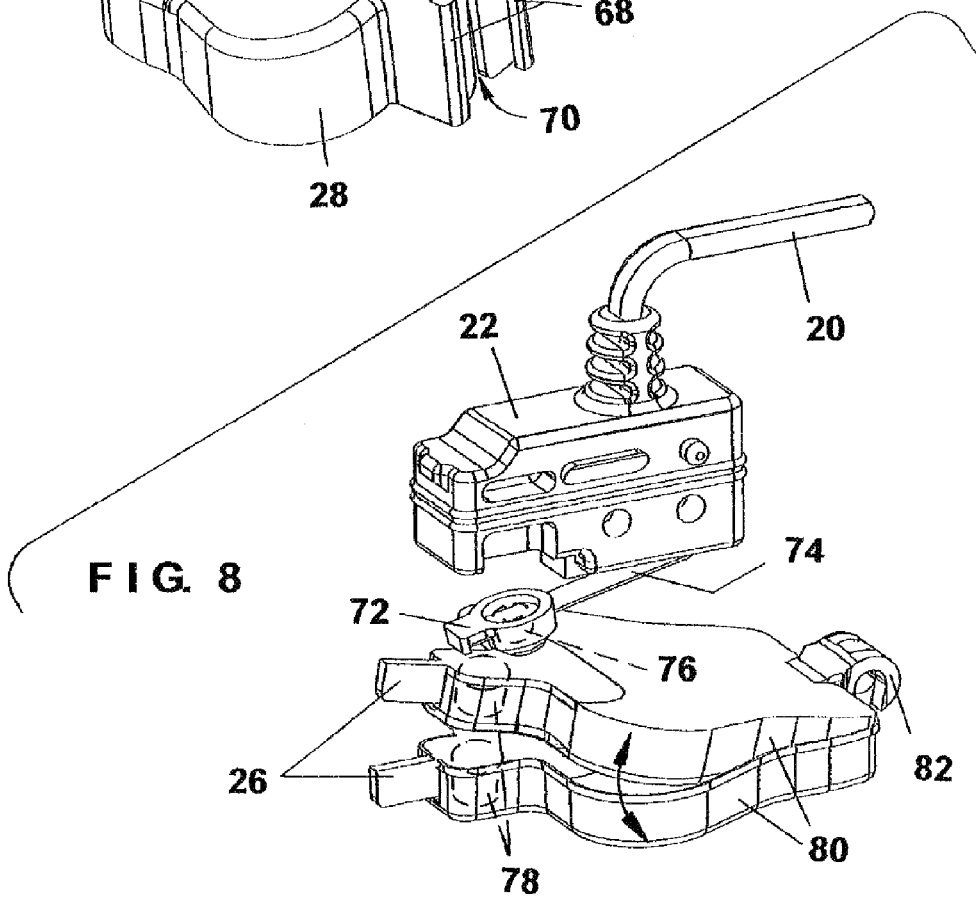
FIG. 8 is a perspective view of a preferred embodiment of micro switch and float body that can be used with float switch housing in FIG. 7 and the most preferred embodiment of the present invention clamping assembly, with the micro switch being shown located above the float body in a position simulating that experienced during actual use, so that the larger magnet associated with the float body during its upward deployment is able to successfully interact with the smaller magnet associated with the arm downwardly depending from the micro switch, and thereby activate the micro switch to generate and send a signal to shut off fluid production.
Figure 9:
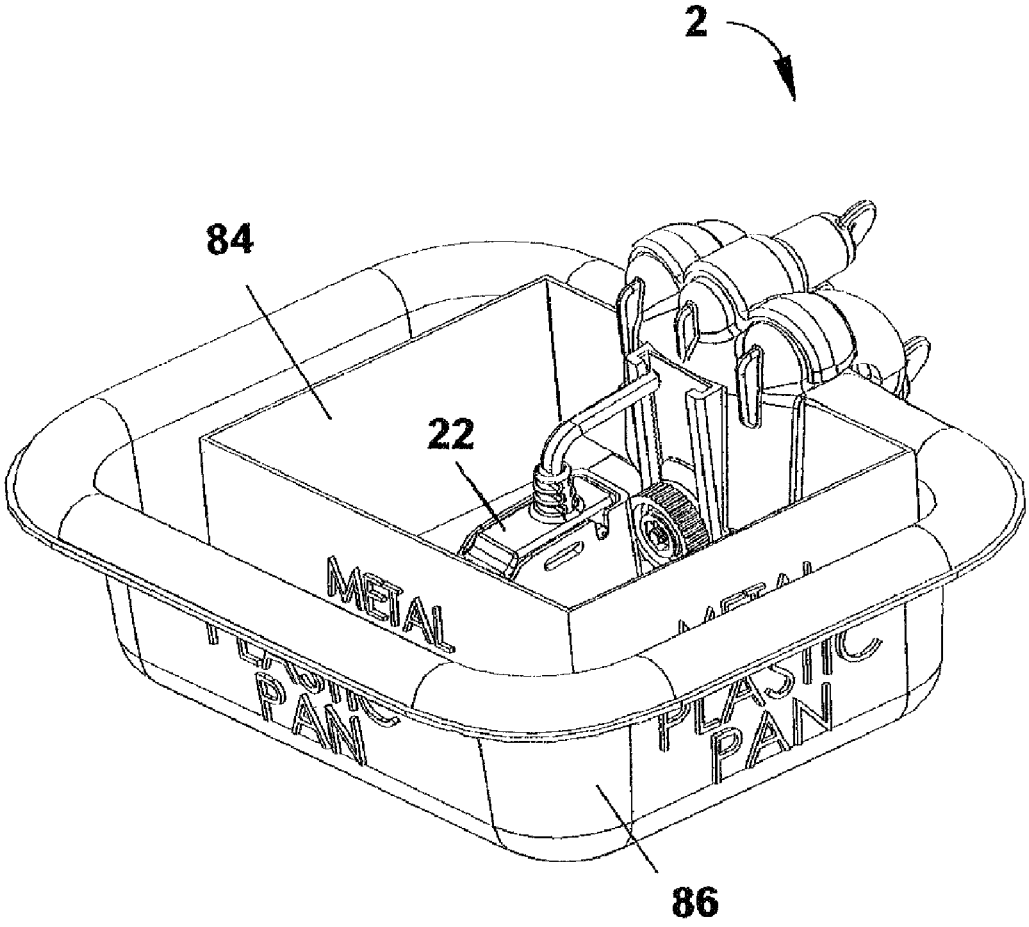
FIG. 9 is a perspective view of the most preferred embodiment of the present invention clamping assembly in its preferred position of use clamped over the upper edge, lip, or outwardly-extending flange of either a metal pan or a plastic pan via at least two thumbscrews, and with a float switch securely connected to the rail plate of the front clamping member.
Figure 10:
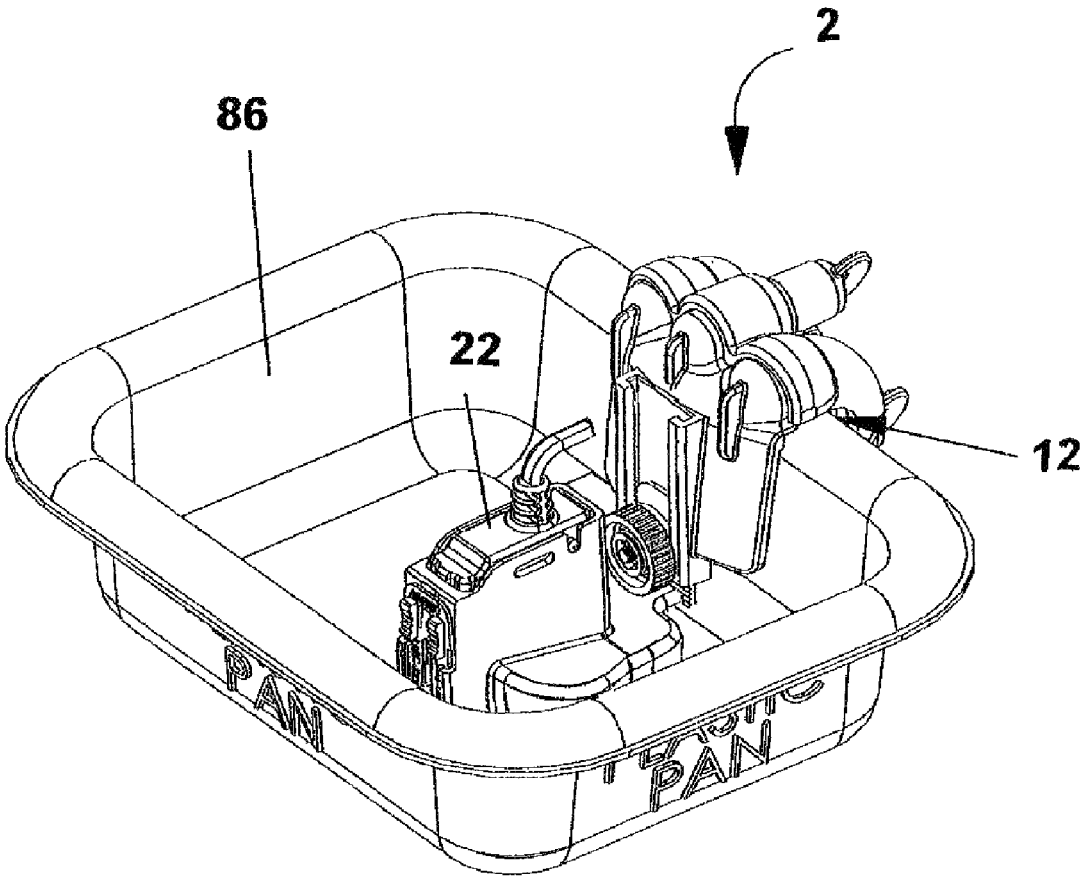
FIG. 10 is a perspective view of the most preferred embodiment of the present invention clamping assembly showing a float switch securely positioned within a representative plastic pan, which is similar in content to FIG. 9, but reveals more detail about the clamping assembly positioning relative to the pan than FIG. 9.

FIG. 1 shows the most preferred embodiment of the two-piece present invention clamping assembly 2 having a float switch housing 28 connected to its rail plate 88, and the lowered positioning of the float switch housing 28 relative to clamping assembly 2 that would be expected when clamping assembly 2 is connected over the upper edge, lip, or flange of the wall of a fluid collection pan, such as the pans 84 and 86 shown in FIGS. 9 and 10. In contrast, FIGS. 3-6 show more detail about the structure of the clamping assembly's front and back clamping members (respectively marked by the numbers 6 and 4 therein, as well as in FIG. 1), while FIG. 2 shows a preferred embodiment of a thumbscrew 10 that can be used to join the two clamping members 4 and 6 together near their top surfaces over the upper edge, lip, or flange of the wall of a fluid collection pan (84, 86, or other). At least one additional thumbscrew 10 (and preferably two thumbscrews 10) can also be used to secure the back clamping member 4 to the exterior surface of an associated fluid collection pan (84, 86, or other) while its upper edge, lip, or flange is positioned within the inverted J-shaped slot 12 that is formed between clamping members 4 and 6 when they are joined together. In addition, FIGS. 9-10 show the present invention clamping assembly in preferred positions of use over the upper edge, lip, or flange of a fluid collection pan 84 or 86, with FIGS. 7-8 showing preferred structure for a float switch housing 28 with an integral rail plate connection 34, a float body 80, and a micro switch 22 that all can be successfully used with the present invention clamping assembly 2. While FIGS. 1-6 reveal detailed structure about the most preferred embodiment of the present invention clamping assembly 2, it is to be understood that many variations in the present invention are possible and also considered to be a part of the invention disclosed herein, even though such variations are not specifically mentioned or shown. As a result, a reader should determine the scope of the present invention by the appended claims.

FIG. 1 shows the most preferred embodiment of the present invention clamping assembly 2, having a two-piece configuration that allows for a quick and easy assembly over the upper edge, lip, or outwardly-extending flange of a fluid collection pan (such as but not limited to the pans 84 and 86 shown in FIGS. 9 and 10). It includes a back clamping member 4 configured for positioning against the exterior/outside surface of a fluid collection pan (84, 86, or other), and a front clamping member 6 configured and positioned against the interior/inside surface of the same pan (84, 86, or other). A rail plate 88 with a vertically-extending interior slot 16 having an open-front configuration is integral with the exterior surface of the front clamping member 6 and provides a quick installation means for attachment of a float housing 28 and the pivotally deployable float body 80 (see FIG. 8) contained therein. Thus, when float body 80 pivots upwardly within float switch housing 28 in response to rising (not shown) and moves beyond a pre-determined maximum threshold level considered safe, the interaction between a large magnet 78 associated with float body 80 and a smaller magnet associated with a micro switch 22 also supported by the float switch housing 28, causes micro switch 22 to send a shut-off signal to the source of fluid production (not shown) to stop fluid flow. The open-front configuration in slot 16 is located remotely from the exterior surface of front clamping member 6 and facilitates the connection of float switch housing 28 to the present invention clamping assembly 2. FIG. 1 also shows two thumbscrews 10 extending rearwardly from back clamping member 4. The leftmost thumbscrew 10 shown in FIG. 1 joins the front clamping member 6 to back clamping member 4 that results in the creation of an inverted J-shaped slot 12 between them. The other thumbscrew 10 shown in FIG. 1 helps to secure back clamping member 4 against the exterior surface of an associated pan (84, 86, or other) while its upper edge, lip, or outwardly-directed flange is inserted within the inverted J-shaped slot 12 between front clamping member 6 and back clamping member 4. Although one thumbscrew 10 in most applications is adequate for securely joining front clamping member 6 and back clamping member 4 together, and only one thumbscrew 10 can be used to secure back clamping member 4 against the exterior surface of an associated fluid collection pan (84, 86, or other), the present invention clamping assembly 2 is not limited only to the use of two threaded thumbscrews 10, as is shown in FIGS. 5 and 6, where the most preferred embodiment of back clamping member 4 employs three threaded openings 48 each configured for the insertion of a different thumbscrew 10. The preferred placement of the three threaded openings 48 into a generally triangular configuration is also shown in FIGS. 5 and 6. FIG. 1 further shows front clamping member 6 having three vertically-extending external strength-enhancing ridges 8 on its exterior surface above and laterally to the upper end of rail plate 88, as well as a ridged surface 18 in rail plate 88 that is adjacent to the left side of the open-front configuration shown for the slot 16. Although hidden from view in FIG. 1 it is contemplated for slot 16 to have a ridged surface 18 on both left and right sides of the open-front configuration of slot 16. FIG. 1 further shows back clamping member 4 extending above front clamping member 6, with the surplus height extending upwardly beyond the upper surface of front clamping member 6 being present to allow successful insertion of posts 50 into receiving bores 56. The respective height dimensions of back clamping members 4 and front clamping member 6 are not critical, and either could be greater or less than that shown in FIG. 1 as long as they provide a sturdy connection to the upper portion of a fluid collection container or pan (84, 86, or other) for stable installation of float body 80 for reliable and extended duration fluid monitoring operation. FIG. 1 further shows a float switch housing 28 attached to rail plate 88 via a rail plate connection member 34 integral to the portion of float housing 28 remote from test plate 24. A common threaded fastener 32 and a lock-nut 38 having complementary threads and an easily hand-manipulated grooved outer surface (not identified by a separate number) are used to raise and lower rail plate connection member 34 relative to rail plate 88 and establish fixed positioning for the rail plate connection member 34 within slot 16 when the needed height for effective float body 80 operation is reached. FIG. 1 further shows rail plate connection member 34 having a ridged surface 14 in a position that allows it to engage the ridge surfaces 18 of rail plate 88 on the right and left sides of the open-front configuration of slot 16 (shown in FIG. 1). It is the engagement of ridged surfaces 14 and 18 that permits accurate incremental raising and lowering of float switch housing 28 relative to an associated pan (84, 86, or other) for placement of the float body 80 (see FIG. 8) inside float switch housing 28 at the exact threshold height needed for shutting off the fluid-producing unit or system (not shown) responsible for fluid or condensate accumulation in pan 84, 86, or other, and also maintaining float body 80 in a stable orientation throughout its fluid level monitoring use, thereby substantially reducing the risk of fluid overflow. Lock-nut 38 can be easily and simply loosened via hand-manipulation for height adjustment of float switch housing 28 relative to pan (84, 86, or other), and then re-tightened after such an upward or downward adjustment. FIG. 7 shows the hex-shaped indentation 60 on rail connection plate member 34 that is employed for holding the head of fastener 32 so that it does not protrude or otherwise interfere with the vertical movement of rail plate connection member 34 within the slot 16 of rail plate 88. FIG. 1 also shows the positioning of a micro switch 22 within the top portion of float switch housing 28, and micro switch 22 having upwardly directed electrical wiring 20 used to connect micro switch 22 to the fluid producing unit (not shown) responsible for directing condensate or other fluid into the pan (84, 86, or other) to which the present invention clamping assembly 2 in connected. In addition, FIG. 1 shows a test plate 24 associated with float switch housing 28 for determining whether float body 80 is properly operating, the end lever 26 of float body 80 (see FIG. 8) in two positions (an upper/deployed position and a lowered/non-deployed position), the snap-fit connection 30 between micro switch 22 and float switch housing 28 that keeps the micro switch 22 firmly secured to float switch housing 28 for consistent positioning of the float body 80 relative to micro switch 22 for reliable shut-off signal production when needed, and the pivoting pin connection 36 for float body 80 that allows movement between its upper/deployed position and its lowered/non-deployed position within float switch housing 28. Further, although FIG. 1 shows back clamping member 4, front clamping member 6, and float switch housing 28 having no surface texture, it is contemplated for each to have any texture or surface decorative enhancement that does not interfere with its function.

FIG. 2 shows a preferred embodiment of a thumbscrew 10 that can be used with the most preferred embodiment 2 of the present invention to secure back clamping member 4 to front clamping member 6 over the top edge, lip, or flange of a fluid collection pan (such as but not limited to pan 84 or 86 in FIGS. 9 and 10). Although the use of thumbscrews 10 is preferred in the present invention clamping assembly 2, other conventional fastening means (not shown) can also be used. Further, the number of thumbscrews 10 used, as well as their size and positioning, are not critical as long as secure attachment of front clamping member 6 and back clamping member 4 over the top edge, lip, or flange of a pan (84, 86, or other) is achieved so as to indefinitely sustain float body 80 in the originally established level orientation needed for continued and reliable function. FIG. 2 shows thumbscrew 10 having an elongated configuration, a threaded end 42, an enlarged head 44, and a non-threaded central portion 46 between threaded end 42 and enlarged head 44. Although it is preferred for enlarged head 44 to be oversized for easy hand-manipulation while tightening back clamping member 4 and front clamping member 6 over the upper edge, lip, or flange of a fluid collection pan (84, 86, or other), the configurations of head 44 and threaded end 42 shown in FIG. 1 should only be considered representative, and not limiting. While one thumbscrew 10 is shown to be used with the present invention 2 to connect back clamping member 4 to front clamping member 6, and one thumbscrew 10 is preferred, more than one thumbscrew 10 may also be used. Further, the configuration of thumbscrew 10 shown in FIG. 2 is preferred for securing back clamping member 4 to the exterior surface of the pan (84, 85, or other 6) while its top edge, lip, or flange is inserted into the inverted J-shaped slot 12, however, the configuration shown in FIG. 2 is not critical. As long as the thumbscrews 10 used are easily gripped and manipulated for prompt connection of preferred embodiment 2 to a fluid collection pan 84 or 86, or other support structure (not shown) associated with a fluid collecting container, any desired size, shape, location, and surface texture for thumbscrew 10 can be considered within the scope of the present invention. However, in determining the size, number, shape, location, and/or surface texture of thumbscrews 10, as in all aspects of present invention structure and design, it is preferred that the material cost relating thereto only be increased where additional benefit is derived.

Figure 3:
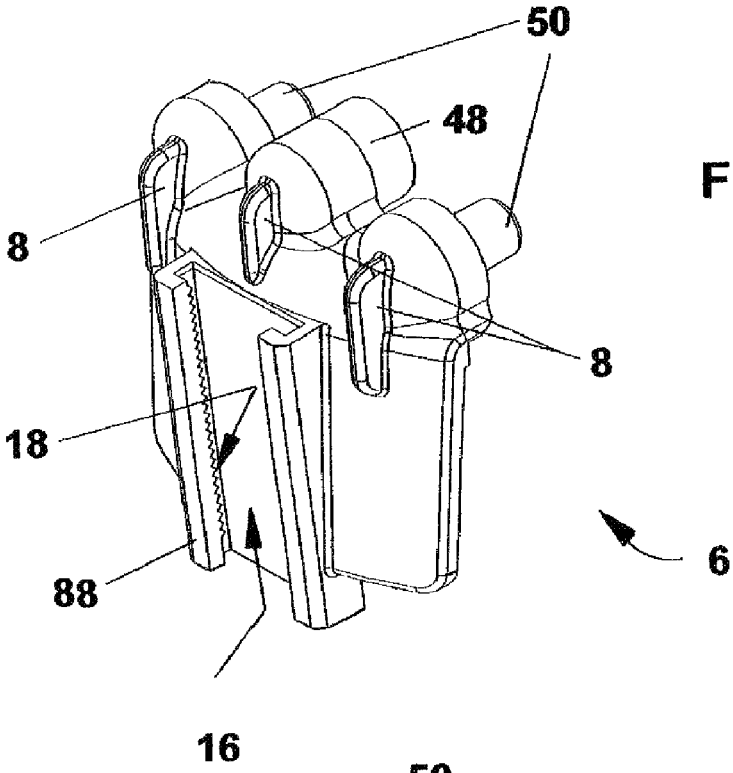
FIG. 3 is a perspective view of the exterior surface of the front clamping member used as a part of the most preferred embodiment of the present invention, which in its position of use is secured against the interior surface of the wall of a fluid collection pan having its upper edge, lip, or flange inserted within the inverted J-shaped slot formed between the front and back clamping members when they are joined together, with the exterior surface of the front clamping member also shown to have several vertically-extending external strengthening ribs near its top surface and a centrally positioned integral rail plate, with the rail plate having a slot with an open-front configuration and a vertically-extending ridged surface adjacent to the left side of the open-front configuration of the slot.
Figure 4:
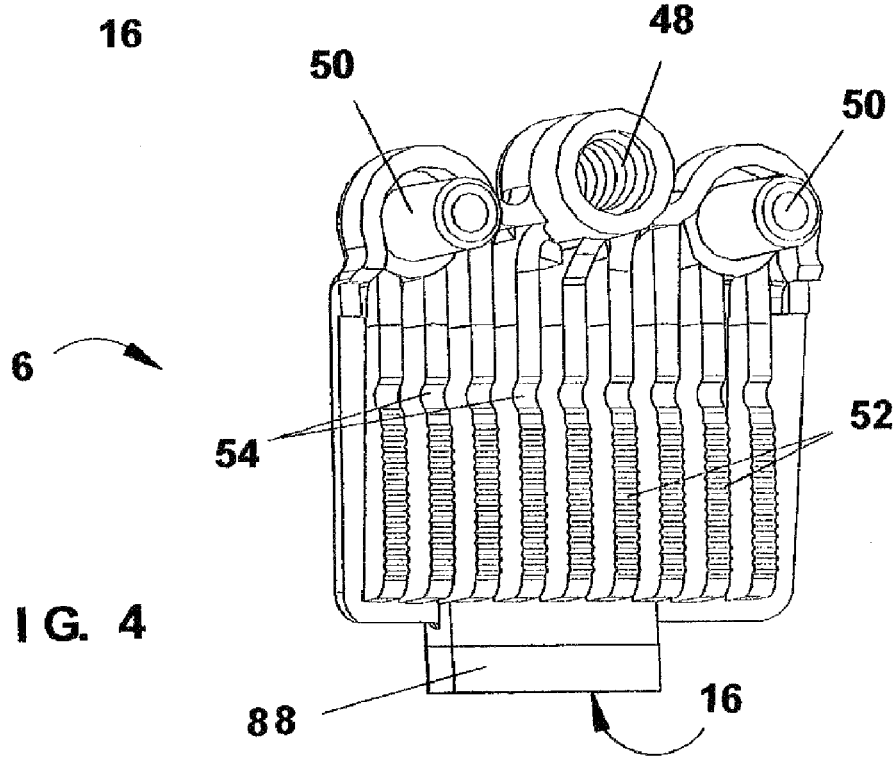
FIG. 4 is a front view of the interior surface of the front clamping member shown in FIG. 3, with FIG. 4 showing the front clamping member having a horizontally-extending threaded opening therethrough centrally near its top surface and two horizontally-extending posts also near the clamping member's top surface, with one post positioned on each side of the horizontally-extending threaded opening, and the interior surface of the front clamping member also being shown to have a plurality of vertically-extending interior ribs each with a central concave area and a lower ridged surface texture below the concave area, with the concave areas in adjacent ribs aligned with one another, and the rail plate shown extending below the interior ribs.

FIGS. 3 and 4 show the front clamping member 6 of the most preferred embodiment of the present invention clamping assembly 2 that during its use to support a float body 80 within a fluid collection container or pan (84, 86, or other) for fluid level monitoring is secured over the top edge, lip, or flange of the container or pan to the back clamping member 4 shown in FIGS. 5 and 6. When installed into their positions of use respectively against the inside and outside surfaces of a vertically-extending wall of the container or pan (84, 86, or other), it is contemplated for front clamping member 6 to be positioned against the inside surface of the pan wall and for back clamping member 4 to be positioned against the outside surface of the pan wall. FIG. 3 is a perspective view of the exterior surface of front clamping member 6, which would be facing away from the pan wall supporting it during use. FIG. 3 shows three vertically-extending strengthening ribs 8 projecting outwardly from the exterior surface of front damping member 6 in positions above and laterally to a rail plate 88 that also projects outwardly from the exterior surface of front clamping member 6. FIG. 3 further shows rail plate 88 having an open-ended vertically-extending slot 16 and an open-front configuration in slot 16 that is remotely located from the exterior surface of front clamping member 6. In FIG. 3, the exterior surface of rail plate 88 with its open-front configuration appears to be positioned outwardly at an angle from the exterior surface of front clamping member 6. However, in referring to FIG. 1, it appears that when front clamping member 6 and back clamping member 4 are joined together to form a J-shaped slot 12, the exterior surface of rail plate 88 has substantially vertically-extending orientation, and it is the exterior surface of front clamping member 6 that seems to have an angled orientation rearward toward back clamping member 4. In addition, FIG. 3 shows a ridged surface 18 adjacent to the left side of slot 16 and extending substantially from the top of rail plate 88 to the bottom of rail plate 88. As previously noted in the discussion of FIG. 1, ridged surface 18 (and a similar ridged surface 18 that is hidden in FIG. 3 on the other side of the open-front configuration of slot 16) is used with the ridged surface 14 (shown in FIG. 7 on rail plate connection member 34) for secure engagement of one to the other, as well as to allow incremental upward and downward adjustment of float switch housing 28 relative to an associated fluid collection pan. (84, 86, or other) when needed for placement of float body 80 (see FIG. 8) at the proper elevation above pan (84, 86, or other) for timely shut-off of a fluid-producing unit should the depth of fluid accumulated in the pan (84, 86, or other) exceed a pre-determined threshold level considered safe. On the opposed side of front clamping member 6, and extending in an opposed direction to ridges 8 and rail plate 88, FIG. 3 shows a threaded opening 48 located between two projections or posts 50, all of which are positioned near the top perimeter of front clamping member 6.

In contrast to FIG. 3, FIG. 4 is a front view of the interior surface of the front clamping member 6 in the most preferred embodiment of the present invention clamping assembly 2, and reveals a horizontally-extending threaded opening 48 centrally near the top of front clamping member 6. When looking at FIG. 3, one sees a strengthening ridge 8 where the opposed end of threaded opening 48 would be if it were open-ended on both of its ends, confirming that threaded opening 48 has a closed interior end even though it is not visible in FIG. 4. FIG. 4 also shows the interior surface of front clamping member 6 having two horizontally-extending strengthening projections or posts 50 that are in a substantially perpendicular orientation relative to the interior surface of front clamping member 6. FIG. 4 also shows projections or posts 50 located near the top portion of front clamping member 6, with one post 50 located on each side of the centrally located threaded opening 48. As one can see in FIG. 4, it is preferred for threaded opening 48 to be in a position slightly raised above that of the adjacent posts 50 so that the spaced-apart posts 50 provide a reproducible level positioning of the clamping assembly 2 over the top edge, lip, or outwardly-extending flange of a pan (84, 86, or other). In addition, FIG. 4 further shows the interior surface of front clamping member 6 having a plurality of vertically-extending ribs 52 each with a central concave area 54 and a ridged surface texture (no independent component number is assigned thereto) below concave area 54, with the concave areas 54 in adjacent ribs 52 aligned with one another to provide a source of air venting collectively between ribs 52. Although ribs 52 help to add structural strength to front clamping member 6, the ridged surface texture of each rib 52 below concave area 54 also assists in the secured gripping connection between the interior surface of a fluid collection pan or container (84, 86, or other) and front clamping member 6 when the thumbscrews 10 extending through the two lower threaded openings 48 (shown in FIGS. 5 and 6) in back clamping member 4 are tightened against the exterior surface of the pan or container (84, 86, or other) while its top edge, lip, or flange is secured within inverted J-shaped slot 12. The concave area 54 on ribs 52 also collectively assist in the venting of air through either side of the portion of the inverted J-shaped slot 12 (see FIG. 1) present between the front clamping member 6 and the vertically-extending wall of a pan (84, 86, or other) should float switch housing 28 be set at a vertical height relative to pan (84, 86, or other) that allows the depth of fluid collected therein to reach the lower ends of ribs 52. In addition, FIG. 4 shows rail plate 88 extending in downward direction below ribs 52, which is not critical. The amount of rail plate 88 extending below ribs 52 would be dictated by the intended application and how much vertical adjustment is desired to ensure continued and reliable deployment of float body 80 in that application for fluid shut-off signal generation. Further, the symmetrical configuration of front clamping member 6 shown in FIGS. 3 and 4 is preferred to ensure its balanced and level support upon a pan (84, 86, or other), although some variation should be considered within the scope of the present invention as long as it is does not adversely affect the deployment capability of float body 80. No drilling of a hole in upper portion of pan (84, 86, or other) is required during installation or use of the present invention clamping assembly 2.

FIGS. 5 and 6 show the back clamping member 4 of the most preferred embodiment of the present invention that during its use is secured over the top edge, lip, or flange of a fluid collection container or pan (84, 86, or other) to the front clamping member 6 shown in FIGS. 3 and 4, which together support a pivoting float body 80 within the container or pan (84, 86, or other) to monitor unsafe fluid level changes therein. When installed respectively into their positions of use against the inside and outside surfaces of a vertically-extending wall of the container or pan (84, 86, or other), it is contemplated for front clamping member 6 to be positioned against the inside surface of the pan wall and for back clamping member 4 to be positioned against the outside surface of the pan wall. FIG. 5 is a perspective view of the exterior surface of back clamping member 4, which would be facing away from the pan wall supporting it during use. FIGS. 5 and 6 show the back clamping member 4 having a lateral notch 12 on both of its sides. The notch is marked by the number 12 as it forms the top portion of the inverted J-shaped configuration 12 created between back clamping member 4 and front clamping member 6 when they are joined to one another by at least one thumbscrew 10. During its use, nearly all of back clamping member 4 is positioned outside of an associated fluid collection container (84, 86, or other). FIGS. 5 and 6 also show back clamping member 4 having three open-ended and horizontally-extending threaded openings 48 through it and forming a generally triangular configuration, with each one configured for insertion of a fastener, such as but not limited to the thumbscrew 10 shown in FIG. 2. FIG. 6 also shows back clamping member 4 having two receiving bores 56 each configured for connection to a different one of the posts 50 shown in FIGS. 3 and 4, and a ribbed structure 90 at the closed end of the inverted J-shaped slot 12 that is configured to assist in air venting, as well as the secure fixation of the wall of a fluid collection pan (such as 84, 86, or other) within the inverted J-shaped slot 12. The perspective view in FIG. 5 of the exterior surface of back clamping member 4 mainly reveals the preferred positioning of three horizontally-extending threaded openings 48 therethrough in a generally triangular configuration. In contrast, the front view in FIG. 6 of the interior surface of back clamping member 4 shows the preferred positioning of three horizontally-extending threaded openings 48, receiving bores 56, and two side projections 92 each of which is immediately below a different notch 12 (part of inverted J-shaped slot 12, as explained above) that further assist the thumbscrews 10 in retaining the upper portion of a pan with an enlarged lip or flange, such as but not limited to the plastic pan 86 shown in FIGS. 9 and 10, within the J-shaped slot 12 formed between front clamping member 6 and back clamping member 4 when they are connected together in their usable positions. Although FIG. 1 shows the upper surface of back clamping member 4 extending above the top surface of front clamping member 6, the relative sizes of front clamping member 6 and back clamping member 4 are not critical or limited to that shown in FIGS. 3-6, as long as each is sufficiently large and/or properly proportioned to fulfill its intended function without undue material waste. The number, configuration, size, spacing, surface texture, and coverage of ribbed structure 90 relative to the interior surface of back clamping member 4 can be different than that shown in FIG. 6 and would be determined according to the strength requirements appropriate to a needed application. Receiving bores 56 can also have a configuration different from that shown in FIG. 6, however, they should be dimensioned to fit closely around a post 50. Further, while it is preferred for the present invention to have the same number of receiving bores 56 and posts 50, the number of each employed can be different from that shown in FIGS. 5 and 6. Also, in contrast to positioning shown in FIGS. 5 and 6, any receiving bore 56 could be associated with back clamping member 4, with its matching post 50 on front clamping member 6, however, the number, positioning, and configuration of posts 50 and receiving bores 56 in FIGS. 3-6 are preferred for a secure connection between front clamping member 6 and back clamping member 4 after their installation. When front clamping member 6 and back clamping member 4 are joined via a thumbscrew 10 tightened within the uppermost threaded opening 48, posts 50 would be inserted through receiving bores 56, using them as a guide. Thumbscrews 10 would then be inserted through the remaining threaded openings 48 and tightened against a wall of a fluid collecting pan (84, 86, or other) while its upper edge is inserted between front clamping member 6 and back clamping member 4. Should the upper portion of a plastic condensate pan or other support surface have an arcuate outwardly-extending flange (such as that shown for pan 86 in FIG. 10), side projections 92 would assist in retaining such a flange within the J-shaped slot 12 formed between front clamping member 6 and back clamping member 4. The connection between front clamping member 6 and back clamping member 4 is such that the thumbscrews 10 inserted through the two lower threaded openings 48 in the previously mentioned triangular configuration become positioned against the exterior surface of the associated fluid collection pan (84, 86, or other). In addition to accommodating different upper edge configurations of fluid collecting pans (84, 86, or other), the adjustable connection of front clamping member 6 and back clamping member 4 against one another and a pan (84, 86, or other fluid collecting container) accommodates vertically-extending walls having differing thickness dimensions. Furthermore, although FIGS. 5 and 6 show back clamping member 6 having a symmetrical configuration, and the symmetrical configuration is preferred to ensure its balanced and level support upon a pan (84, 86, or other), some variation from that shown in FIGS. 5, and 6 should be considered within the scope of the present invention as long as it does not adversely affect the deployment capability of float body 80.

FIGS. 7 and 8 respectively show an empty float switch housing 28, a float body 80, and a micro switch 22 that can be easily and effectively mounted by the most preferred embodiment of the present invention clamping assembly 2 on the vertically-extending wall of a fluid collection pan (84, 86, or other). FIG. 7 shows float switch housing 28 having an upper opening/chamber 62 for use in securely positioning the micro switch 22 shown in FIG. 8 so that electrical wiring 20 extending from micro switch 22 can be connected to a fluid-producing unit (not shown) for sending it a shut-off signal when the depth of fluid in pan (84, 86, or other) exceeds a pre-determined depth considered safe. FIG. 8 shows a float body positioned below micro switch 22. The positioning of micro switch 22 and float body 80 shown in FIG. 8 is similar to that existing when both are secured within float switch housing 28. FIG. 8 also shows float body 80 in two positions (one above the other), with the lower position being a non-deployed position wherein no shut-off signal is sent, and the higher position being a deployed position that activates micro switch 22 to generate and send a fluid shut-off signal. The two-headed vertically-oriented arrow on the near side of float body 80 indicates the bi-directional movement intended for float body 80 during its use. FIG. 8 further identifies the pivoting axis 82 on one end of float body 80, and the test lever 26 in a position on float body 80 opposed to that of pivoting axis 82. During installation, inspection, and maintenance activity, test lever 26 can be used to manipulate and confirm whether float body 80 is properly functioning at the predetermined depth of fluid accumulation considered safe. In addition, FIG. 8 shows micro switch 22 having a downwardly-extending arm 74 with a cup 72 on its distal end, and a small magnet 76 positioned within cup 74 in a position immediately above the larger magnet 78 shown within float body 80. As rising fluid raises float body 80 into its elevated/deployed position, the larger magnet 78 within float body 80 will open or close micro switch 22 (as needed) so that it sends a shut-off signal to the system or unit (not shown) responsible for the rising fluid. FIG. 7 shows the lower portion of float switch housing 28 having a generally butterfly-shaped configuration similar to that of float body 80, so that float body 80 substantially fills the lower portion of float switch housing 28 to prevent wobble and keep debris (not shown) from entering the space between them, which otherwise could interrupt the proper and uninhibited vertical deployment of float body 80 within float switch housing 28. FIG. 7 further shows float switch housing 28 preferably having upper guides 58 for easy alignment of micro switch 22 during its insertion into upper chamber/opening 62, and snap-fit connections 30 that assist in maintaining micro switch 22 in its preferred position of use, once installed. In addition, FIG. 7 shows a preferred vent opening 70 in the front portion of float switch housing 28 where a test plate 24 can be attached (see FIG. 1), which prevents airlock malfunction in float body 80 during any vertical movement, particularly upward deployment. FIG. 7 also shows the front portion of float switch housing 28 having lateral guide bars 68 that form a slot/channel 66 into which a test plate 24 can be inserted, and protrusions 64 that help to secure a test plate 24 into a preferred position of use after initial insertion into slot/channel 66. In addition, FIG. 7 shows float switch housing 28 having an integral rail plate connection member 34 with a central hex-shaped protrusion 60 (the rearward indentation of which holds the hex-shaped head of the threaded fastener 32 shown in FIG. 1 to allow free vertical movement of rail plate connection member 34 within the slot 16 of rail plate 88) and a ridged surface 14 that engages the ridged surfaces 18 formed into rail plate 88 adjacent to the left and right sides of the open-front configuration of its slot 16. Although the protrusion 60 in FIG. 7 is shown to have a hex-shaped configuration, the hex-shaped configuration should not be considered as limiting, and other configurations such as but not limited to rectangular and octagonal could also be used. When electrical wiring 20 extending from micro switch 22 is connected into the circuit of the system or unit generating the fluid to be collected in the container or pan (84, 86, or other) to which present invention clamping assembly 2 is attached, rising fluid collected in the container or pan (84, 86, or other) will cause the associated float body 80 to similarly rise, and when the depth of the collected fluid reaches a pre-determined height no longer considered safe, the circuit of the system or unit will either be interrupted or completed so as to suspend the generation of additional fluid.

FIGS. 9 and 10 show two possible configurations of pan contemplated for use in association with the present invention clamping assembly 2. A metal pan 84 having a straight upper edge is shown in FIG. 9, with a plastic pan 86 having an enlarged upper edge, lip, or flange being shown in both FIGS. 9 and 10. The dual illustration of two fluid collection pans in FIG. 9, metal pan 84 and plastic pan 86, is to re-enforce the concept that the configuration of the inverted J-shaped slot 12 in the present invention clamping assembly 2 accommodates fluid collection containers or pans (84, 86, or other) having different upper edge configurations and wall thickness dimensions, lessening the prior burden on installers to carry an assortment of clamping assemblies for accommodating a variety of collection pan wall configurations and dimensions. In contrast, the most preferred embodiment of the present invention clamping assembly 2 can accommodate most fluid collection pan wall configurations. FIG. 10 was also included as a supporting illustration to generally show one example of the relative positioning of an installed float switch housing 28 relative to a plastic pan 86 when the present invention clamping assembly 2 is used as the means of securing one to the other, as the pans illustrated in FIG. 9 (pans 84 and 86) obscure visibility for much of the float switch housing 28 shown. Further, in FIG. 10 the large arcuate upper lip (or flange) of plastic pan 86 appears to be effectively accommodated within inverted J-shaped slot 12. Although preferred embodiment 2 can be used with a plastic condensate pan having a configuration similar to that shown in FIG. 16, due to its elongated thumbscrew 10 configuration, elongated threaded openings 48, and side projections 92, preferred embodiment 2 is equipped to accommodate a large variety of pan configurations, which is a distinct advantage over the majority of prior art devices used to mount a float switch housing 28 fluid depth monitoring.

When the upper portion of a fluid collection pan (84, 86, or other) is inserted into the inverted J-shaped slot between front clamping member 6 and back clamping member 4, thumbscrews 10 are inserted through back clamping member 4. The uppermost thumbscrew 10 is advanced until it becomes tightened in the threaded opening 48 formed in the interior surface of front clamping member 6 preferably near its top edge. In contrast, the remaining two thumbscrews 10 in preferred embodiment 2 are tightened until they extend completely through their respective threaded openings 48 in back clamping member 4. They are then further advanced toward the portion of the exterior surface of the inserted fluid collection pan (84, 86, or other) that is inserted within the inverted J-shaped slot 12 created between front clamping member 6 and back clamping member 4, until each thumbscrew 10 firmly engages the exterior surface of the pan (84, 86, or other) and thereby provides a secure connection between it and the two clamping members 4 and 6. Since the engagement of thumbscrews 10 with the exterior surface of fluid collection pan (84, 86, or other) also forces the interior surface of fluid collection pan (84, 86, or other) against the ribs 52 on the interior surface of front clamping member 6, the gripping connection between the interior surface of the pan and ribs 52 is also strengthened as a result of the use of the additional thumbscrews 10. At least two thumbscrews 10 are generally preferred for securely positioning back clamping member 4 and front clamping member 6 against the interior and exterior surfaces of a vertically-extending wall of a fluid collection pan (84, 86, or other) so that the float body 80 positioned within the float switch housing 28 (while float switch housing 28 is connected via its rail plate connection member 34 to the rail plate 88 of front clamping member 6) can operate without wobbling or other orientation change that could adversely affect the reliability of its fluid monitoring capability and shut-off activating function. The materials from which the most preferred embodiment 2 is made can vary, but must be impervious to corrosion. Preferably for cost considerations, although not limited thereto, it is contemplated for front clamping member 6, float body 80, back clamping member 4, thumbscrews 10, and lock-nuts 38 to all be made from plastic. Resistance to UV radiation is not necessarily a contemplated feature of the present invention, unless dictated by the application. Manufacture of the present invention clamping assembly components could be accomplished by blow molding, injection molding, assembly of pre-formed individual components, or a combination thereof, with the choice of manufacturing being determined by the anticipated purchase cost to consumers and the expected duration of use without maintenance, parts replacement, or repair. Although size of the present invention is not critical, for many condensate collection applications, the length, width, and height dimensions of the combined front clamping member 6 and back clamping member 4 would each have a maximum dimension of approximately three inches.

To facilitate and expedite installation, thumbscrews 10 could already be attached to back clamping member 4 by partial insertion within threaded openings 48. Thus, it is contemplated that all an operator/installer would have to do is place back clamping member 4 against the exterior surface of a fluid collection pan (84, 86, or other) with projections or posts 50 positioned above the upper edge of fluid collection pan (84, 86, or other), then place front clamping member 6 against the interior surface of the same fluid collection pan (84, 86, or other) with receiving bores 56 positioned above the upper edge of fluid collection pan (84, 86, or other), and while using the receiving bores 56 as guides, inserting projections or posts 50 through into the receiving bores 56 and then tightening each thumbscrew 10 until back clamping member 4 becomes firmly fixed against clamping member 6. In the preferred embodiment 2, the topmost thumbscrews 10 can be inserted and tightened first, with the two remaining thumbscrews 10 inserted and tightened thereafter against the exterior surface of the fluid collection pan (84, 86, or other) having its upper edge, lip, flange inserted within inverted J-shaped slot 12 to further stabilize the positioning of front clamping member 6 during its use for reliable vertical movement of float body 80 within the float switch housing 28 having fixed connection to the rail plate 88 integral to front clamping member 6. No drilling of holes through the upstanding wall of fluid collection pan (84, 86, or other) is required. Also, once front clamping member 6 is in its secured and usable position and float switch housing 28 is connected to rail plate 88, the installer or operator would check float body 80 to confirm that it has the stable and level positioning required for reliable and uninhibited vertical movement, and that it is operable at the appropriate fluid depth for successful overflow-prevention function. Electrical wiring 20 extending from micro switch 22 would then be connected to the system or unit providing water or other fluid collected by pan (84, 86, or other). Thereafter, when collected fluid fills pan (84, 86, or other) beyond a pre-determined depth considered safe to prevent overflow, the present invention float body 80 is raised by the rising fluid to the height that causes micro switch 22 to send a signal to interrupt fluid production. Minimal maintenance is contemplated. If float switch housing 28 is made from translucent, transparent, or partially transparent materials, an operator could visibly assess the effective operation of float body 80 without removing it from its position of use or separating float switch housing 28 from rail plate 88. Design considerations for front clamping member 6, back clamping member 4, and thumbscrews 10 include but are not limited to price point, ease of manufacture, and effectiveness of operation. It is further contemplated for front clamping member 6 and back clamping member 4 to have a generally compact design and construction for efficient packaging and transport.

I claim:

1. A clamping assembly for use in association with a fluid collection container having a vertically-extending wall with a top edge and for securely mounting a float switch housing and micro switch in a variety of fixed locations relative to the wall, so that when fluid accumulating in the container exceeds a predetermined depth considered safe, the deployable end of a float body pivotally secured within the float switch housing will be raised a sufficient amount to activate the micro switch and cause it to generate a shut-off signal that is sent to the system providing fluid to the container to stop fluid production, said clamping assembly comprising:

a front clamping member having an interior surface, an exterior surface, and a top end;

a rail plate associated with said exterior surface of said front clamping member, said rail plate having an open-ended slot and an open-front configuration remotely positioned from said exterior surface;

a threaded opening positioned near said top end of said front clamping member and extending into said interior surface of said front clamping member;

a back clamping member having an inside surface, an outside surface, an upper end, and two opposed lateral notches;

at least two threaded openings extending through said back clamping member, with one of said at least two threaded openings being an upper threaded opening located near said upper end of said back clamping member and positioned for alignment with said threaded opening associated with said front clamping member near its top end; and at least two fasteners each having a threaded configuration allowing for secure engagement with a different one of said threaded openings associated with said back clamping member, so that when said back clamping member is positioned adjacent to the vertically-extending wall of a fluid collecting container with said inside surface positioned adjacent to the exterior surface of the wall, and a first one of said at least two fasteners is inserted through said upper threaded opening in said back clamping member, and further when said front clamping member is positioned adjacent to the same vertically-extending wall with said interior surface positioned adjacent to the interior surface of the wall, said first fastener inserted through said upper threaded opening in said back clamping member can be advanced into said threaded opening associated with said front clamping member and tightened to draw said back clamping member toward said front clamping member and join them to one another, wherein said front and back clamping members so joined with said first one of said fasteners become supported by the vertically-extending wall and form an inverted J-shaped configuration around the portion of the wall between said front and back clamping members, with said notches associated with said back clamping member becoming part of said inverted J-shaped configuration, and when the remaining ones of said at least two fasteners are each inserted through a different one of the remaining ones of said threaded openings through said back clamping member and advanced until they make tight contact with the exterior surface of the vertically-extending wall between said front and back clamping members, a float switch housing configured for monitoring fluid level change in the fluid collecting container having a portion of its vertically-extending wall positioned within said inverted J-shaped slot can be securely fixed to said rail plate associated with said front clamping member for reliable and repeated operation of the float body and micro switch supported by the float switch housing to prevent additional fluid from entering the fluid collecting container when accumulated fluid therein exceeds a pre-determined depth considered safe.

2. The clamping assembly of claim 1 wherein said back clamping member further comprises a plurality of vertically-extending strengthening ribs associated with said inside surface between said opposed lateral notches.

3. The clamping assembly of claim 1 further comprising a plurality of vertically-extending ribs associated with said interior surface of said front clamping member and wherein said ribs further comprise a concave area and ridged surface texture on at least a portion of said ribs below said concave area.

4. The clamping assembly of claim 1 wherein said exterior surface of said front clamping member further comprises at least one vertically-extending strengthening rib located above said rail plate.

5. The clamping assembly of claim 1 wherein said front clamping member has a bottom end in a position opposed to said top end, and said rail plate extends downwardly beyond said bottom end.

6. The clamping assembly of claim 1 wherein said back clamping member further comprises a side projection located near to each said notch.

7. The clamping assembly of claim 1 wherein said back clamping member comprises three of said threaded openings and said three threaded openings form a triangular configuration.

8. The clamping assembly of claim 1 wherein said rail plate further comprises two ridged surfaces within said slot and adjacent to said open-front configuration on both of its sides.

9. The clamping assembly of claim 1 wherein each of said at least two fasteners is a thumbscrew comprising an enlarged head configured for easy hand-manipulation.

10. A clamping assembly for use in association with a fluid collection container having a vertically-extending wall with a top edge and for securely mounting a float switch housing and micro switch in a variety of fixed locations relative to the wall, so that when fluid accumulating in the container exceeds a predetermined depth considered safe, the deployable end of a float body pivotally secured within the float switch housing will be raised a sufficient amount to activate the micro switch and cause it to generate a shut-off signal that is sent to the system providing fluid to the container to stop fluid production, said clamping assembly comprising:

a front clamping member having an interior surface, an exterior surface, a top end, and a bottom end;

a rail plate associated with said exterior surface of said front clamping member, said rail plate having an open-ended slot and an open-front configuration remotely positioned from said exterior surface;

at least two projections in substantially perpendicular relation to said interior surface of said front clamping member, said at least two projections located near to said top end;

a threaded opening positioned near said top end of said front clamping member between said two projections;

a plurality of vertically-extending ribs associated with said interior surface of said front clamping member between said top and bottom ends;

a back clamping member having an inside surface, an outside surface, an upper end, a lower end, and two opposed lateral notches;

at least two threaded openings extending through said back clamping member, with one of said at least two threaded openings being an upper threaded opening located near said upper end of said back clamping member and positioned for alignment with said threaded opening associated with said front clamping member near its top end;

one receiving bore associated with said inside surface of said back clamping member for each of said at least two projections associated with said interior surface of said front clamping member, said receiving bores each configured for a close fit around one of said projections; and at least two fasteners each having a threaded configuration allowing for secure engagement with a different one of said threaded openings associated with said back clamping member, so that when said back clamping member is positioned adjacent to the vertically-extending wall of a fluid collecting container with said inside surface positioned adjacent to the exterior surface of the wall, and a first one of said at least two fasteners is inserted through said upper threaded opening in said back clamping member, and further when said front clamping member is positioned adjacent to the same vertically-extending wall with said interior surface positioned adjacent to the interior surface of the wall, and also with said at least two projections associated with said front clamping member each aligned with a different one of said receiving bores associated with said back clamping member, said first fastener inserted through said upper threaded opening in said back clamping member can be advanced into said threaded opening between said two projections positioned near said top end of said front clamping member and tightened to draw said back clamping member toward said front clamping member and join them to one another, wherein said front and back clamping members so joined with said first one of said fasteners become supported by the vertically-extending wall and form an inverted J-shaped configuration around the portion of the wall between said front and back clamping members, with said notches associated with said back clamping becoming part of said inverted J-shaped configuration, and when the remaining ones of said at least two fasteners are each inserted through a different one of the remaining ones of said threaded openings through said back clamping member and advanced until they make tight contact with the exterior surface of the vertically-extending wall between said front and back clamping members, a float switch housing configured for monitoring fluid level change in the fluid collecting container having a portion of its vertically-extending wall positioned within said inverted J-shaped slot can be securely fixed to said rail plate associated with said front clamping member for reliable and repeated operation of the float body and micro switch supported by the float switch housing to prevent additional fluid from entering the fluid collecting container when accumulated fluid therein exceeds a pre-determined depth considered safe.

11. The clamping assembly of claim 10 wherein said back clamping member further comprises a plurality of vertically-extending strengthening ribs associated with its inside surface between said notches.

12. The clamping assembly of claim 10 wherein at least some of said vertically-extending ribs associated with said interior surface of said front clamping member further comprise a ridged surface texture.

13. The clamping assembly of claim 12 wherein said vertically-extending ribs each have a concave area, and said ridged surface texture is located between said concave area and said bottom end of said front clamping member.

14. The clamping assembly of claim 10 wherein said exterior surface of said front clamping member further comprises at least one vertically-extending strengthening rib located above said rail plate.

15. The clamping assembly of claim 10 wherein said rail plate extends beyond said bottom end of said exterior surface of said front clamping member.

16. The clamping assembly of claim 10 wherein said back clamping member further comprises a side projection located near to each said notch.

17. The clamping assembly of claim 10 wherein said back clamping member comprises three of said threaded openings and said three threaded openings form a triangular configuration.

18. The clamping assembly of claim 10 wherein said rail plate further comprises a ridged surface within said slot on both sides of said open configuration.

19. The clamping assembly of claim 10 wherein each of said at least two fasteners further comprises an enlarged head configured for easy hand-manipulation.

20. A clamping assembly for use in association with a fluid collection container having a vertically-extending wall with a top edge and for securely mounting a float switch housing and micro switch in a variety of fixed locations relative to the wall, so that when fluid accumulating in the container exceeds a predetermined depth considered safe, the deployable end of a float body pivotally secured within the float switch housing will be raised a sufficient amount to activate the micro switch and cause it to generate a shut-off signal that is sent to the system providing fluid to the container to stop fluid production, said clamping assembly comprising:

a front clamping member having an interior surface, an exterior surface, a top end, and a bottom end;

a rail plate associated with said exterior surface of said front clamping member, said rail plate having an open-ended slot and an open configuration remotely positioned from said exterior surface, said rail plate further comprising a ridged surface within said slot on both sides of said open configuration;

at least two projections in substantially perpendicular relation to said interior surface of said front clamping member, said at least two projections located near to said top end;

a threaded opening positioned near said top end of said front clamping member between said two projections;

a plurality of vertically-extending ribs associated with said interior surface of said front clamping member between said top and bottom ends;

a back clamping member having an inside surface, an outside surface, an upper end, a lower end, two opposed lateral notches, and a plurality of strengthening ribs associated with said inside surface between said notches;

at least two threaded openings extending through said back clamping member, with one of said at least two threaded openings being an upper threaded opening located near said upper end of said back clamping member and positioned for alignment with said threaded opening associated with said front clamping member near its top end;

one receiving bore associated with said inside surface of said back clamping member for each of said at least two projections associated with said interior surface of said front clamping member, said receiving bores each configured for a close fit around one of said projections; and at least two thumbscrews each having a threaded configuration allowing for secure engagement with a different one of said threaded openings associated with said back clamping member, so that when said back clamping member is positioned adjacent to the vertically-extending wall of a fluid collecting container with said inside surface positioned adjacent to the exterior surface of the wall, and a first one of said at least two thumbscrews is inserted through said upper threaded opening in said back clamping member, and further when said front clamping member is positioned adjacent to the same vertically-extending wall with said interior surface positioned adjacent to the interior surface of the wall, and also with said at least two projections associated with said front clamping member each aligned with a different one of said receiving bores associated with said back clamping member, said first thumbscrew inserted through said upper threaded opening in said back clamping member can be advanced into said threaded opening between said two projections positioned near said top end of said front clamping member and tightened to draw said back clamping member toward said front clamping member and join them to one another, wherein said front and back clamping members so joined with said first one of said thumbscrews become supported by the vertically-extending wall and form an inverted J-shaped configuration around the portion of the wall between said front and back clamping members, with said notches associated with said back clamping becoming part of said inverted J-shaped configuration, and when the remaining ones of said at least two thumbscrews are each inserted through a different one of the remaining ones of said threaded openings through said back clamping member and advanced until they make tight contact with the exterior surface of the vertically-extending wall between said front and back clamping members, a float switch housing configured for monitoring fluid level change in the fluid collecting container having a portion of its vertically-extending wall positioned within said inverted J-shaped slot can be securely fixed to said rail plate associated with said front clamping member for reliable and repeated operation of the float body and micro switch supported by the float switch housing to prevent additional fluid from entering the fluid collecting container when accumulated fluid therein exceeds a pre-determined depth considered safe.

* * * * *